United States Patent [19]

Perrault et al.

[11] Patent Number: 4,860,570

[45] Date of Patent: Aug. 29, 1989

[54] LOW TONNAGE HIGH QUALITY THREAD STAMPING

[76] Inventors: Frederick Perrault, 1727 Date Ave., Torrance, Calif. 90503; Raymond E. Perrault, 3845 Crest Rd., Rancho Palos Verdes, Calif. 90274

[21] Appl. No.: 204,880

[22] Filed: Jun. 10, 1988

Related U.S. Application Data

[63] Continuation-in-part of Ser. No. 14,116, Feb. 2, 1987, abandoned, which is a continuation of Ser. No. 827,890, Feb. 10, 1986, abandoned.

[51] Int. Cl.[4] ..... B21D 53/24

[52] U.S. Cl. ..... 72/379; 72/404; 10/152 R

[58] Field of Search ..... 72/51, 368, 379, 404, 72/414, 415, 474, 475; 10/86 R, 152 R, 153

[56] References Cited

U.S. PATENT DOCUMENTS

| | | |
|---|---|---|
| 139,861 | 6/1873 | Boeklen . |
| 161,912 | 4/1875 | Taplin . |
| 256,525 | 4/1882 | Whiting . |
| 322,052 | 7/1885 | Emery . |
| 322,053 | 7/1885 | Emery . |
| 357,768 | 2/1887 | Furbish . |
| 463,445 | 11/1891 | Densmore . |
| 468,293 | 2/1892 | Coleman . |
| 708,932 | 9/1902 | Smith . |
| 1,111,749 | 9/1914 | Joseph . |
| 1,271,070 | 7/1918 | Palecheck . |
| 1,433,882 | 10/1922 | Fancher et al. . |
| 1,465,484 | 8/1923 | Richter . |
| 1,611,942 | 12/1926 | Persons . |
| 1,676,919 | 9/1932 | Persons . |
| 1,876,386 | 9/1932 | Baynes . |
| 1,919,940 | 7/1933 | Hall . |
| 1,949,618 | 3/1934 | Mollberg . |
| 1,957,530 | 5/1934 | Dibner . |
| 1,994,428 | 3/1935 | Keil . |
| 2,064,342 | 12/1936 | England . |
| 2,153,388 | 4/1939 | Newman . |
| 2,271,762 | 2/1942 | Draper . |
| 2,429,910 | 1/1949 | Alvin . |
| 2,441,580 | 5/1948 | Mageoch . |
| 2,826,810 | 3/1958 | Peterson . |
| 2,862,215 | 12/1958 | Gross . |
| 3,006,003 | 10/1961 | Johnson, Jr. . |
| 3,056,197 | 10/1962 | Lawson . |
| 3,086,421 | 4/1963 | Hamman . |
| 3,665,881 | 5/1972 | Koch et al. . |
| 4,266,310 | 5/1981 | Perrault et al. ..... 10/86 R |

FOREIGN PATENT DOCUMENTS

| | | |
|---|---|---|
| 164592 | 11/1949 | Austria . |

*Primary Examiner*—Lowell A. Larson

[57] ABSTRACT

This invention provides a method for producing an internally threaded part through a stamping operation in one embodiment of which a die is provided with a curvature greater than that of the completed part. A punch is provided having ridges thereon collectively complementary in cross section to a thread to be produced and of a curvature slightly less than that of said cavity in said die, and a workpiece is engaged by said punch so as to force it against the die and form grooves in the workpiece the full depth of the thread to be produced, after which the workpiece is given a cylindrical shape, bring the ends of the grooves into registry so as to provide an internally threaded part. Only a single sroke normally is required in forming the grooves. In another embodiment, a sheet metal workpiece is engaged by a punch having curved convex protrusions defining a plurality of ribs and a die having a cavity with a curved convex surface so as to provide grooves therein from the ribs, the workpiece then being engaged again by at least one additional similar punch and die so as to extend the grooves, the workpiece finally being shaped to a cylindrical form so that the grooves provide a screw thread. The cross-sectional dimension of the grooves may be increased by successive punches.

57 Claims, 7 Drawing Sheets

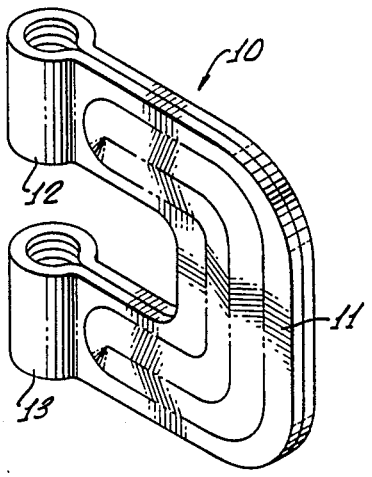
FIG. 1.
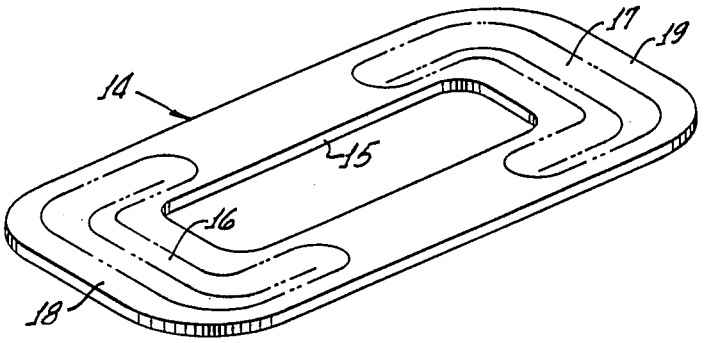
FIG. 2.
FIG. 3.
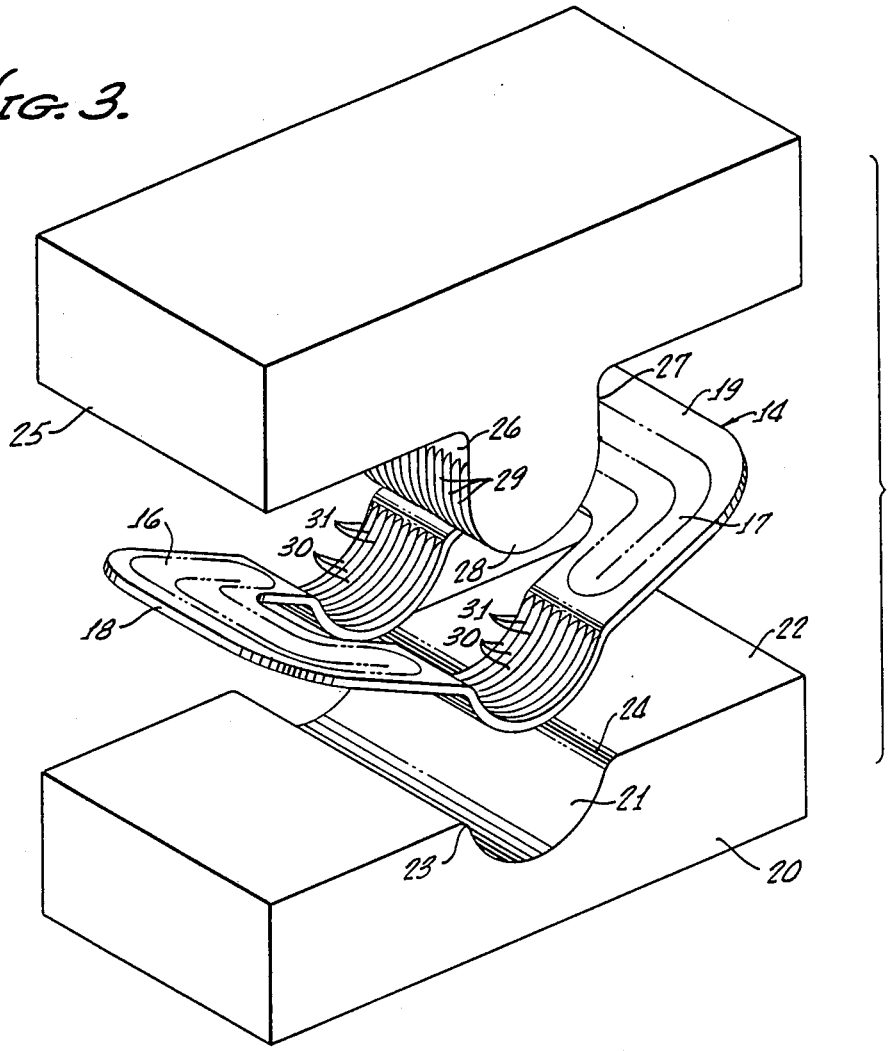

FIG. 9.
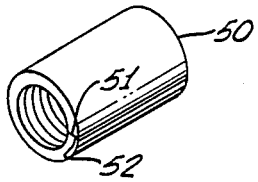
FIG. 10.
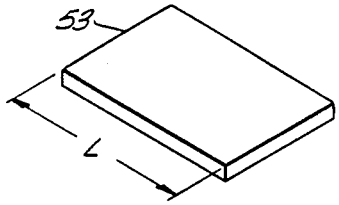
FIG. 15.
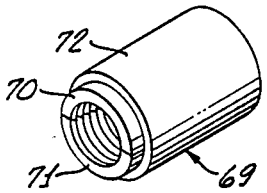
FIG. 11.
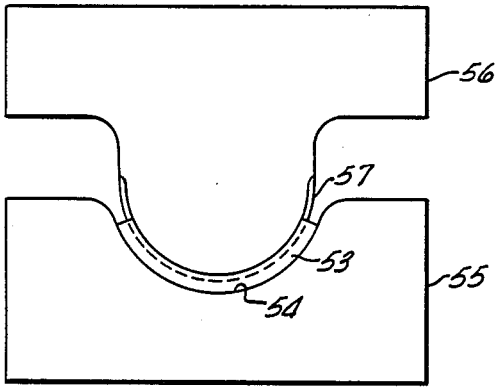
FIG. 12.
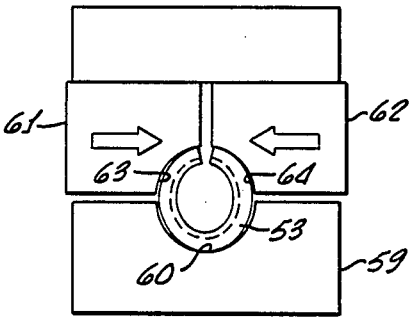
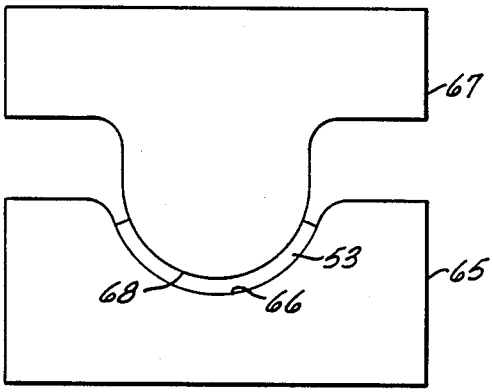
FIG. 13.
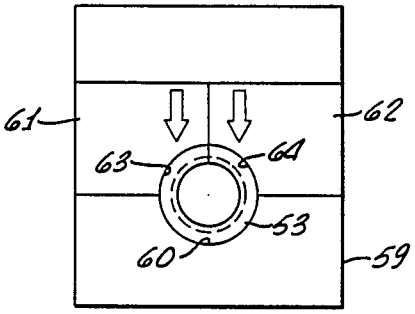
FIG. 14.
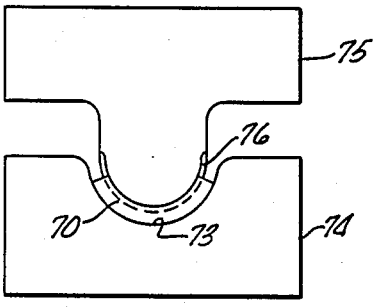
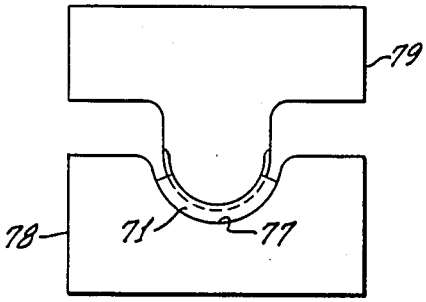
FIG. 16.
FIG. 17.

FIG. 20.
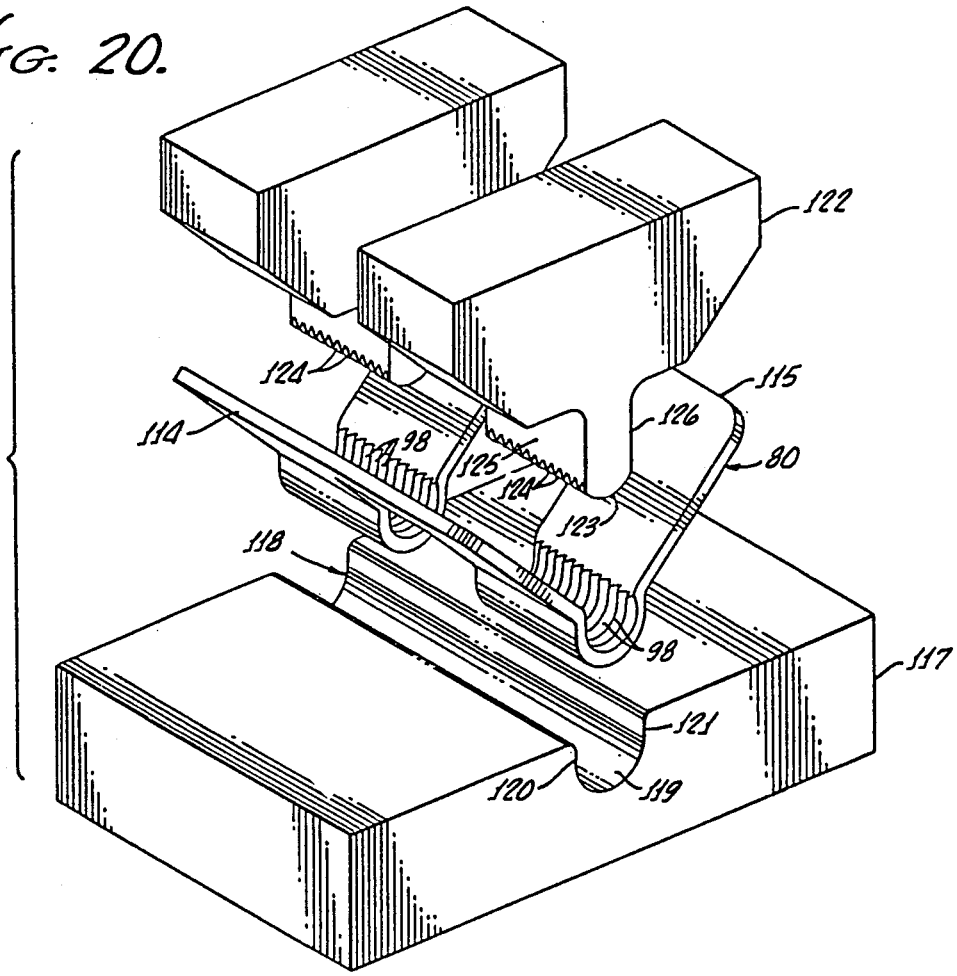
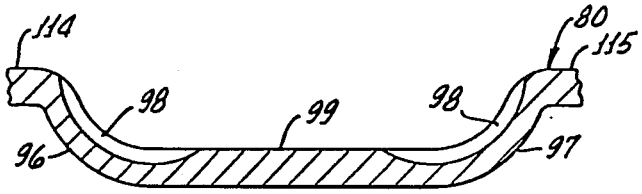
FIG. 21.
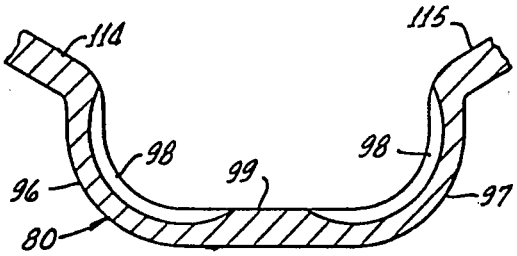
FIG. 22.

LOW TONNAGE HIGH QUALITY THREAD STAMPING

CROSS-REFERENCE TO RELATED APPLICATION

This application is a continuation-in-part of prior pending patent application Ser. No. 014,116, filed Feb. 2, 1987, for Low Tonnage High Quality Thread Stamping, which, in turn, is a continuation of prior patent application Ser. No. 827,890, filed Feb. 10, 1986, for Low Tonnage High Quality Thread Stamping, both now abandoned.

BACKGROUND OF THE INVENTION

In the past, there have been a number of unsuccessful attempts to produce threaded parts in a punch press to eliminate the need for tapping. The advantages of that type of thread forming are apparent, primarily lying in the increased production rates made possible with attendant reduction in the manufacturing costs. Although several impractical prior proposals have been made for accomplishing stamped, threaded parts, this type of operation can be accomplished successfully by the arrangement described in our earlier U.S. Pat. No. 4,266,310. This produces acceptable threaded parts by a punch press operation, but may necessitate relatively complex tooling. In addition, the required press tonnage in some instances may be undesirably large. Certain metals, such as stainless steel, cannot be threaded successfully by this technique.

SUMMARY OF THE INVENTION

The present invention overcomes the problems of the prior art, providing an improved arrangement for forming threads in a punch press without requiring the cutting of the threads. Tooling is simplified and press tonnage requirements are low. The quality and definition of the work hardened thread produced are particularly high.

The invention provides an internally threaded part by initially stamping thread grooves into a sheet metal workpiece. In some instances, these thread grooves, throughout their lengths, may be formed to the full depth of the thread with only a single stroke of the punch press.

In accomplishing this, there is provided a die cavity having a radius of curvature substantially greater than the radius of curvature of the completed part. A punch is similarly contoured, with an allowance being made for the thickness of the workpiece. The punch is provided with ridges on its lower surface which are complementary in cross section to the thread to be produced. The ridges are inclined relative to the axis of curvature such that subsequently the ends of the grooves formed in the workpiece may be brought into registry to produce a helical thread. The radius of curvature of the crests of the ridges preferably is around three times to pi times the radius of the curvature of the completed part at the root of the thread. When the punch strikes the flat sheet metal workpiece to drive it into the cavity, the workpiece is wrapped progressively around the punch as the ridges form the grooves in the workpiece to the full depth of the thread. This progressive forming is accomplished with very low press tonnage requirements. At the same time a high quality thread is produced.

After the thread grooves are formed in the workpiece, it is directed to succeeding die stages where its curvature is increased to ultimately achieve a cylindrical shape. This completes the threaded part.

The completed part also may be made of more than one section, each of which is a threaded cylindrical segment. In this event, less increase in curvature is necessary in succeeding die stages in order to achieve the desired cylindrical shape. If the part is made up of three or more segments, the final curvature may be given to the workpiece as the thread grooves are produced. It is possible, also, in any case, to curve the workpiece before it is struck by the punch that produces the thread grooves.

It is preferred that the workpiece at the stage where the thread grooves are formed extends through an arc of no more than around 120°. In other words, a full 180° semicylindrical segment, or any segment significantly greater than 120°, is undesirable because it will not produce thread grooves of good definition. Particularly at the ends of the grooves, they will be poorly formed and the thread grooves will not be of uniform depth and dimension. It is possible for the workpiece to extend through an arc of less than 120°, but a greater force then is necessary in driving the punch into the workpiece to produce the thread grooves. This has the disadvantage of increasing the press tonnage requirements.

In another embodiment, the grooves are formed incrementally in separate operations. Thus, each groove is formed in segments which have a length less than the circumference of the thread to be produced. The groove is extended in different steps to complete its length so that ultimately it corresponds to the full circumference of the thread. This may be accomplished in two or three stages of a progressive die.

Typically, there will be provided a punch having ridges on its bottom surface defining cylindrical segments which are spaced apart and provided with parallel ribs complementary to a segment of the thread to be produced. The die cavity will have a flat intermediate surface with curved side edge portions. The punch forces the sheet metal workpiece into the die cavity against the curved surfaces, simultaneously forming grooves that are of less length than the circumference of the thread to be produced. The grooves are of the full depth of the thread, except at their ends where they taper to a more shallow depth because of the curvature of the punch. The next die stage has a punch with ridges closer together than at the first stage, and a die cavity narrower than that of the first die. Again the workpiece is forced into the die cavity by the punch, which then extends the grooves to a greater length. The engagement overlaps that of the first die stage so that the grooves are made of uniform depth as they are extended. In some instances, a final stage is required in which the punch has only a single ridge rather than two spaced ridges. The workpiece receives some curvature from the stages which form the grooves, after which it is formed further to assume a cylindrical configuration, thereby completed the threaded part.

BRIEF DESCRIPTION OF THE DRAWINGS

FIG. 1 is a perspective view of a part produced in accordance with this invention;

FIG. 2 is a perspective view of a workpiece prepared for the formation of thread grooves;

FIG. 3 is an exploded perspective view of the die stage where the thread grooves are formed;

FIG. 9 is a perspective view of another kind of part produced through the arrangement of this invention;

FIG. 10 is a perspective view of a workpiece from which the part of FIG. 9 is produced;

FIG. 11 is an elevational view showing the formation of the thread grooves in the workpiece of FIG. 10;

FIGS. 12 and 13 are views of subsequent stages in the forming of the part of FIG. 9;

FIG. 14 is an elevational view of a punch and die for curving the workpiece prior to forming the thread grooves;

FIG. 15 is a perspective view of an additional part manufactured it accordance with this invention;

FIG. 16 ,is an elevational view illustrating the formation of one of the sections of the part of FIG. 15;

FIG. 17 is an elevational view illustrating the formation of the other section of the part of FIG. 15;

FIGS. 19 and 20 are exploded perspective views of additional die stages in the formation of the part;

FIG. 21 is a transverse fragmentary sectional view of the workpiece after being formed at the first die stage;

FIG. 22 is a view similar to FIG. 21, showing the workpiece after the second die stage;

DETAILED DESCRIPTION OF THE INVENTION

Figure 4:
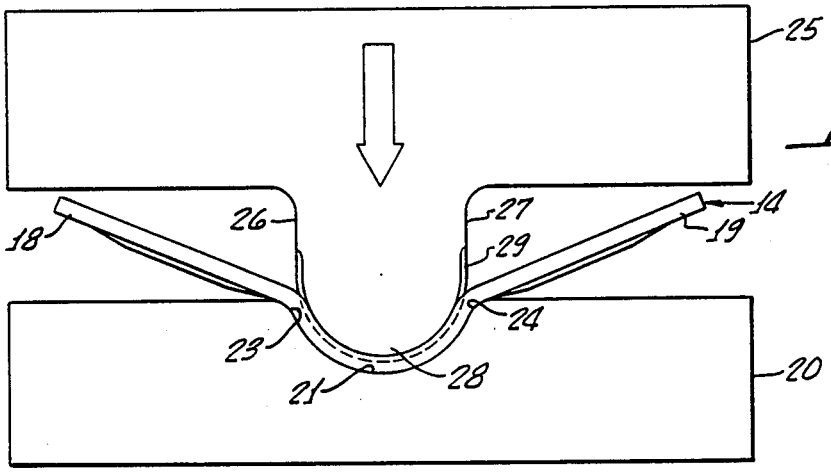
FIG. 4 is an end elevational view showing the formation of the thread grooves in the workpiece.

FIGS. 2 through 8 illustrate sequentially the manufacture of the C-clamp 10 of FIG. 1. This is a sheet metal item, doubled over to form a C-shaped yoke 11, at the ends of which are aligned, axially spaced, identical threaded barrels 12 and 13. A screw can be introduced into one of the barrels to attach the clamp to a supporting structure. Another threaded member then can be received in the other barrel for use as a support for piping or other objects.

The manufacturing sequence of FIGS. 2 through 8 preferably is a punch press operation, arranged as a series of stages in a progressive die. For clarity, however, the die stages are illustrated separately.

In conventional die stages, not shown, the workpiece 14 initially is given the configuration illustrated in FIG. 2. Its outer periphery is rectangular except for having rounded corners, and an enlarged rectangular cutout 15, also with rounded corners, is in its central portion. U-shaped indentations 16 and 17 are provided in the opposite end portions 18 and 19 of the workpiece for forming reinforcing ribs in the completed clamp.

Groove for producing the threads in the barrels 12 and 13 usually are formed to their full depth in one die stage, as illustrated in FIGS. 3 and 4. Positioned beneath the workpiece 14 in this stage is a die 20 having a cavity 21, which defines a segment of a cylinder, and a flat upper surface 22. The cavity 21 in this instance has an angular extent of around 120° to its rounded edges 23 and 24 that connect to the flat upper surface 22, therefore being substantially less than semicylindrical.

Above the die 20 is a punch 25 with a projection on its lower surface having straight sides 26 and 27 and a convexly rounded bottom part 28. The lower portion 28 of the punch 25 is semicylindrical in end elevation and provided with parallel ribs 29 that extend upwardly into the sides 26 and 27. These ribs are for producing thread grooves in the workpiece, and so collectively in cross section they are complementary to the thread to be produced in the two barrels 12 and 13 of the completed part 10. The ribs are inclined relative to the axis of curvature of the punch so that the ends of the grooves they form can be brought into registry to produce a screw thread when the workpiece subsequently is given a cylindrical configuration.

The radius of curvature of the lower portion 28 of the punch is less than that of the cavity 21 in the die 20 so as to make allowance for the thickness of the workpiece 14. Hence, the radius of curvature of the punch portion 28, as viewed in end elevation at the crests of the ribs 29, is less than that of the die cavity 21 by an amount corresponding to the thickness of the completed part 10 at the barrels 12 and 13 between the root of the thread and the outer surface of the barrel. In other words, the crests of the ribs 29 fall along and are inclined relative to an imaginary cylindrical segment the radius of curvature of which is less than the radius of curvature of the cavity 21 by approximately the thickness of the part at the barrels 12 and 13 at the root of the thread.

The central portion of the workpiece 14 is placed over the die cavity 21 in the forming stage of FIGS. 3 and 4, with the end portions 18 and 19 extending out over the flat upper die surface 22 When the punch 25 strikes the central part of the workpiece 14, it forces the central part of the workpiece into the die cavity 21, giving it the contour of the die cavity, while the end parts 18 and 19 of the workpiece become bent upwardly.

The radius of curvature of the imaginary cylindrical segment along which fall the crests of the ribs 29 is approximately in the range of three times to $\pi$ times the radius of curvature of the thread of the completed part at the root of the thread. For example, if the barrels 12 and 13 have a standard one-half inch thread, and thus a one-fourth inch radius at the root of the thread, the radius of curvature of the crests of the ribs, as viewed in end elevation, will be around three-fourths inch. The circumferential length of the curved bottom portion 28 of the punch 29 corresponds to the circumference of the barrels 12 and 13 of the C-clamp 10 at the root of the thread.

In keeping with the fact that the punch has a curvature around one-third that of the completed part at the root of the thread, the curved bottom portion 28 of the punch 25 has an angular extent of about 120°, i.e., one-third of a completed circle. As noted above, the die cavity 21 also extends through an angle of about 120°.

With this arrangement, a single stroke of the press at the die stage illustrated in FIGS. 3 and 4 normally will produce thread grooves 30 in the workpiece 14, with ridges 31 intermediate those grooves, which have the full depth and dimension of the completed thread. With some materials, more than one impact may be preferred for forming the thread grooves, the successive hits increasing the dimensions of the thread grooves in width, depth, or both. As the punch 25 strikes the workpiece 14, first the central part of the lower portion 28 will engage the flat workpiece at a localized area. As the punch continues downwardly, the workpiece is progressively wrapped around the punch as the workpiece is forced against the wall of the die cavity 21 and assumes the contour of the die cavity when the forming is completed. This contrasts with striking the workpiece with rectilinear ridges, as in our patent No. 4,266,310, where the entire length of each groove is formed at the same time when the punch hits the workpiece. The wrapping action of the present invention allows the ribs to penetrate fully into the workpiece as progressive forming occurs. Moreover, by giving the punch a radius of curvature around three times that of the completed part, and contouring the die cavity accordingly, the ribs 29 are caused to provide sizable force components normal to the surface of the workpiece for producing well-defined thread grooves. This is true even at the side edges of the portion of the workpiece which is given the thread grooves.

The compression of the workpiece by the punch and die causes it to become expanded slightly in its length, that is, the direction between its end portions 18 and 19. There is no significant increase in the width of the workpiece.

Variations in die cavity and punch curvature are possible, although at some sacrifice in performance. If the punch is given a radius of curvature greater than around three times that of the completed part, higher press tonnage is needed to achieve full thread depth in a single stroke of the press. This adds to costs and slows production. An extremely large punch curvature will be tantamount to a flat surface and preclude the formation of thread grooves of adequate depth with less than multiple strokes of the pres and more involved tooling. On the other hand, if the punch radius of curvature is reduced significantly below about three times that of the completed part, inadequate force will be exerted at the ends of the grooves and sufficient groove depth will not be realized in those areas.

It is preferred to make the die cavity and punch as cylindrical segments because of ease of manufacture. However, they may be segments of paraboloids or other curves so long as they are of a curvature which is adequately less than the curvature of the completed part.

Figure 5:
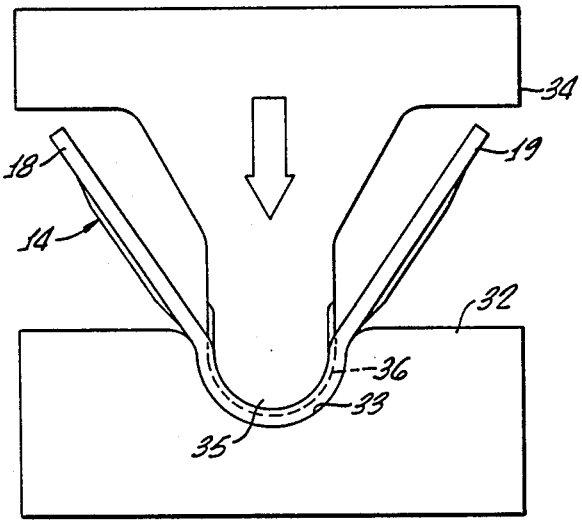
FIG. 5 is an end elevational view of a succeeding die stage in the formation of the part.

The remaining die stages are to bend the workpiece 14 to the final form illustrated in FIG. 1. This includes imparting a cylindrical shape to each of the barrels 12 and 13. To this end, as shown in FIG. 5, the die 39 of the next stage has a cavity 33 which is a cylindrical segment having a radius of curvature less than that of the cavity 21 of the die 20, but still greater than that of the completed barrel. The punch 34 has a lower portion 35 that is convexly rounded on its bottom surface and provided with ribs 36. The overall shape of the lower portion 35 is complementary to that of the die cavity 33, less the thickness of the workpiece 14 from the roots of the thread grooves 30 formed in it in the previous stage. The ribs 36 on he punch 34 are complementary to the grooves 30 and fit down within these grooves as the punch strikes the workpiece. It is necessary to have these ribs in order to avoid deforming the thread grooves. However, the ribs 36 are not employed for creating the thread grooves, this having been accomplished at the prior stage of formation of the workpiece.

The end parts 18 and 19 of the workpiece become bent upwardly further as the central portion of the workpiece is formed into and is given the contour of the die cavity 33.

Figure 6:
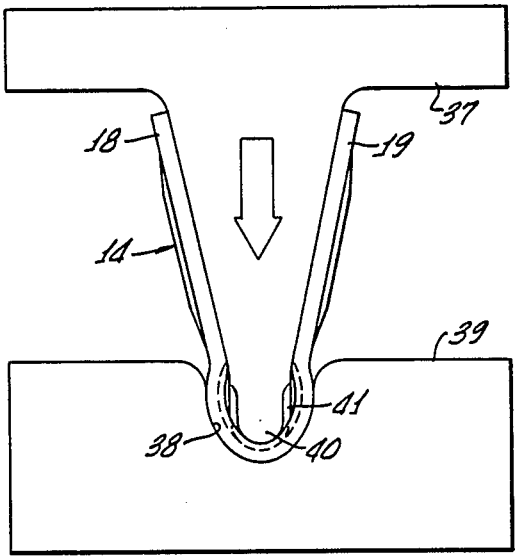
FIG. 6 is an end elevation of a further die stage.

As shown in FIG. 6, a still narrower punch 37 next is employed, driving the workpiece 14 within a cavity 38 and 39. The lower end portion 40 of the punch 37 is rounded and has ribs 41 that fit complementarily within the thread grooves 30, just as did the ribs 36 on the punch 34. The lower portion 40 of the punch 37 strikes only the central portion of the part where the thread grooves have been formed, enabling the end parts 18 and 19 to be bent further up around the periphery of the punch. Again, no formation of the thread grooves 30 is involved, as the function of the ribs 41 is to preserve the thread grooves rather than to define them.

Figure 7:
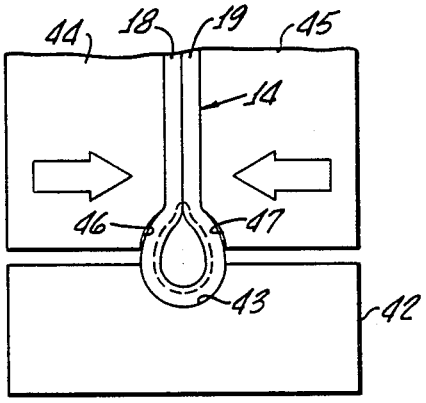
FIG. 7 is an end elevational view of the next die stage.

The next die stage, illustrated in FIG. 7, may include a die 42 with a cavity 43 complementary to one half of the outside of each of the barrels 12 and 13 of the completed part. The punch portion of the die is in two segments 44 and 45, which have lower inner corner portions 46 and 47, respectively, that also are complementary to a portion of the exterior of the barrels 12 and 13. The members 44 and 45 first are driven toward each other, as indicated by the arrows in FIG. 7, causing the end portions 18 and 19 of the workpiece to be forced together and to further close up the barrels 12 and 13 of the completed part. Then the elements 44 and 45 are moved downwardly, as indicated by the arrows in FIG. 8, causing the arcuate corners 46 and 47 to impart a final contour to the exterior of the barrels 12 and 13. As this is done, the end portions of the thread grooves 30 are brought into registry so that the groove 30 and ribs 31 define a helical thread.

The part 50 shown in FIG. 9 is a split threaded sleeve having longitudinal edges 51 and 52 which abut along the length of the part. The sleeve 50 is made from a flat rectangular sheet metal workpiece 53, shown in FIG. 10, which is of a predetermined length L. This length is equal to the circumference of the completed part 50 taken approximately at the root of the thread. The workpiece 53 is formed in the cavity 54 of a die 55, shown in FIG. 11, where it is engaged by a punch 56 having ribs 57 on its protruding lower end, being thus generally similar to the punch 25. The ribs 57 are complementary in cross section to the thread to be produced and have an inclination relative to the axis of curvature to allow the thread grooves to register at their ends to result in a helical thread as the part is formed. The punch 56 in end elevation has a radius equal to approximately three times to $\pi$ times the radius of the completed part 50 at the root of the thread.

The steps for producing the part 50 are similar to those for producing the clamp 10, except that the edges 52 and 53 are brought together as the forming is completed, and there are no side flanges to form a yoke as in the clamp 10. The final two steps, seen in FIGS. 12 and 13, are similar to those illustrated in FIGS. 7 and 8 for the clamp 10. Thus, there is a die 59 with a cavity 60 complementary to half of th part 50, while punch sections 61 and 62 have arcuate portions 63 and 64 corresponding in shape to the remainder of the part 50. The punch sections 61 and 62 may be driven together as in FIG. 12 and then downwardly to complete the forming as shown in FIG. 13.

Instead of being flat when given the thread grooves and ridges, the workpiece may receive its initial curvature prior to this step. In that event, a workpiece such as the workpiece 53 initially is formed in a die 65 having a cavity 66 identical to the cavity 54 of the die 55 (FIG. 14). The punch 67 has a curved lower end 68 which is a cylindrical segment with a radius of curvature the same as that of the die cavity 66 less the thickness of the workpiece 53. After being given an arcuate shape by the punch 67 and die 65, thread grooves and ridges are formed in tooling such as illustrated in FIG. 11. The punch 56 then forces the workpiece 53 against the wall of the die cavity 54 as the ribs 57 form thread grooves in the opposite surface of the workpiece. The differential in curvature between the inner surface of the workpiece 53 and the ribs 57 of the punch 56 results in a progressive forming of the thread grooves and ridges so that again excellent thread definition is obtained in one stroke of the press.

A part 69, such as shown in FIG. 15, also may be produced through the technique of this invention. The provides a threaded sleeve made up of two semicylindrical sections 70 and 71 surrounded by a cylindrical sleeve 72 that holds these two sections together. The two sections 70 and 71 may abut along their longitudinal edges. Thus, the part 69 includes two threaded segments, each of which extends for 180°, rather than a single threaded element of 360°, as in the previously described embodiments. Each of the sections 70 and 71 is made from a rectangular sheet metal workpiece, which in one stroke of the press s provided with thread grooves. As shown in FIG. 16, the section 70 is formed in a cavity 73 in a die 74, being struck by a punch 75 having ribs 76 which produce the thread grooves. Similarly, as seen in FIG. 17, the section 71 is formed in the cavity 77 of a die 78 and struck by a punch 79. The die 78 and punch 77 may be identical to the die 74 and 75, or the same die and punch may be used to form both sections.

Inasmuch as each of the sections 67 and 68 extends for only 180°, rather than 360° as in the prior embodiments, the radius of curvature of the die cavities 71 and 75 need not be as great as before relative to the curvature of the completed part. The ribs of the punches 73 and 77 may fall along a cylindrical segment which has a radius of curvature equal to approximately one and one-half times the radius of curvature of the finished part at the root of the thread.

After the thread grooves are formed as shown in FIGS. 16 and 17, sections 70 and 71 are given an increased curvature without further thread forming to produce the final semicylindrical shapes. Only one more die stage for each may be necessary to accomplish this. Then the two sections 70 and 71 are brought together along their longitudinal edges so that they are coaxial, and the sleeve 72 is fitted around them to complete the part 69.

The internally threaded part also may be made of three or more segments which abut at their longitudinal edges, in which event the segments may be given their final curvatures at the stage where the thread grooves are formed. In those instances, the radius of curvature of the ridges of the punch used in forming the thread grooves equals the radius of curvature of the completed part at the root of the thread.

The invention, therefore, is used to produce segments having a partial thread which is of the full depth and contour of the thread of the completed part. In some instances, the segment is given a greater curvature so as to become cylindrical and produce the threaded part. At other times, segments may be assembled so as to collectively produce the internally threaded part. There may be a combination of these effects in which two segments are given a greater curvature and then brought together to result in the completed part. In any event, the portion of the workpiece given thread grooves preferably extends through an arc of no more than around 120° to assure proper definition of the threads. The angular extent of the threaded portion may be less than 120°, but for a workpiece of a given dimension lengthwise of the thread grooves the press tonnage requirements will become greater.

Figure 18:
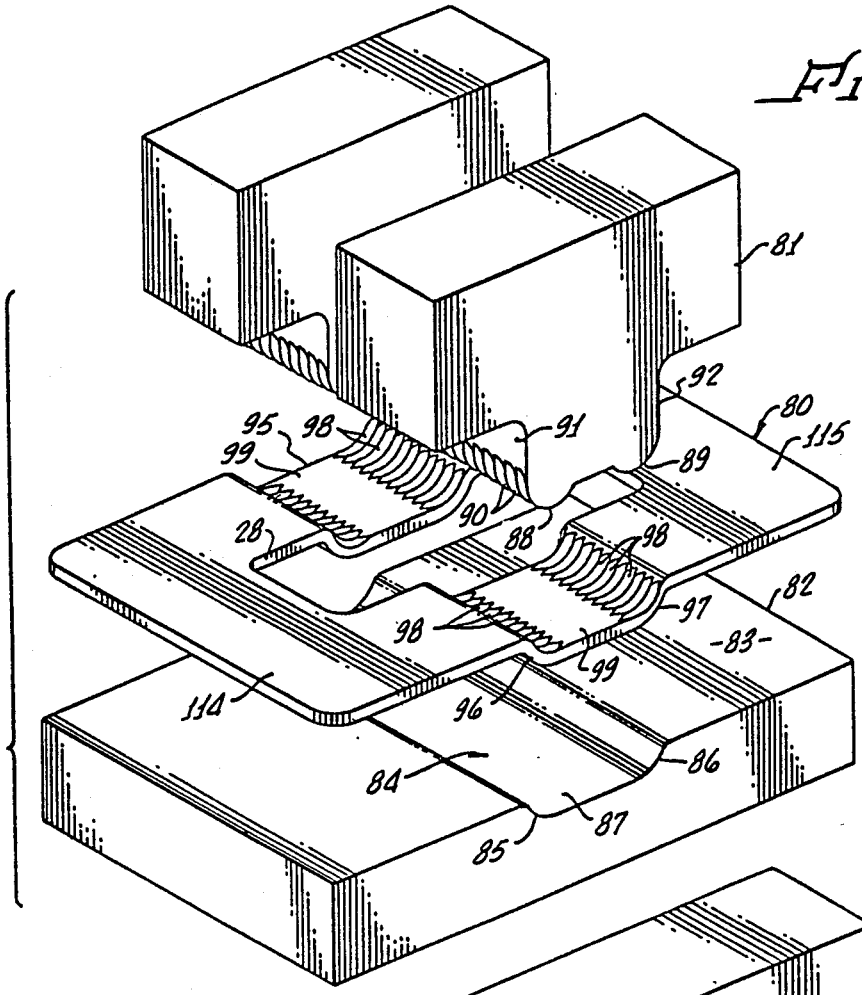
FIG. 18 is an exploded perspective view of the first die stage of another embodiment for forming a part.
Figure 19:
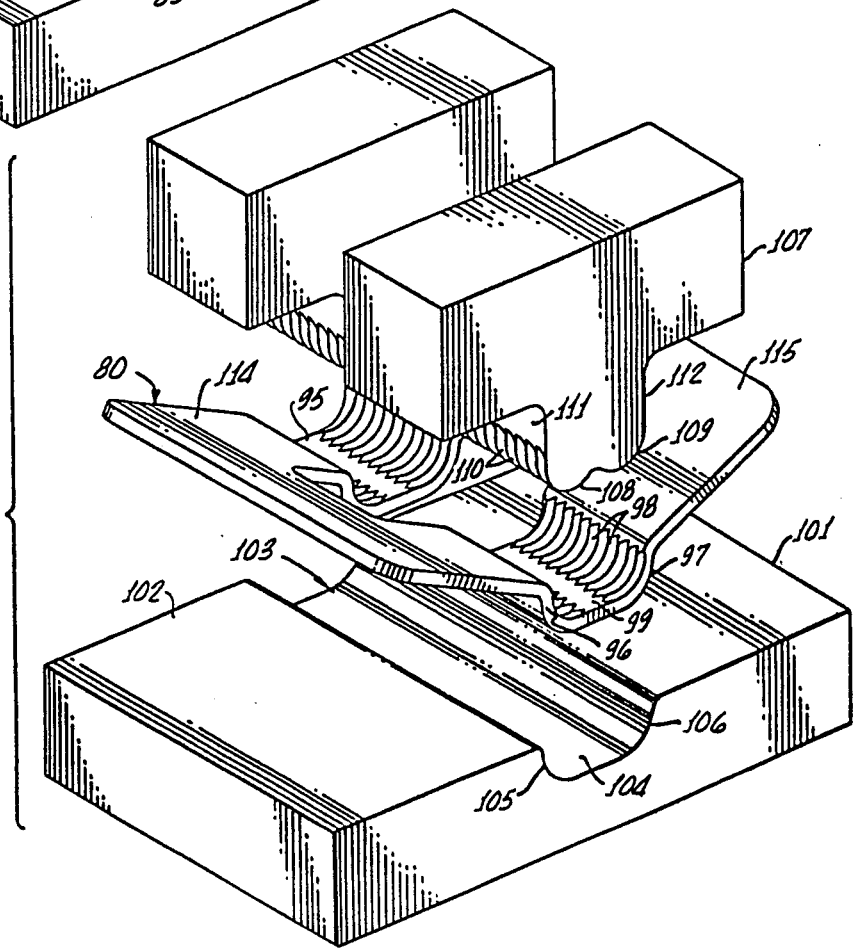

FIGS. 18 through 20 illustrate sequentially another arrangement for the manufacture of the C-clamp 10 of FIG. 1, again in a progressive die in a punch press. In FIG. 18, the sheet metal workpiece 80 has just been formed by a punch 81 and die 82. The latter includes a flat upper surface 83 across which extends a cavity 84 formed as a trough having arcuate concave sides 85 and 86 that incline upwardly and outwardly from the flat bottom 87 of the cavity to the upper surface 83 These sides are cylindrical segments with a circumferential dimension less than the circumference of the thread to be produced. The punch 81 includes two spaced parallel ridges 88 and 89, opposite from the sides 85 and 86 of the die, that project downwardly and are defined by circular segments as seen in end elevation. The radius of curvature of the ridges 88 and 89 is slightly less than that of the cavity sides 85 and 86. The ridges 88 and 89 are formed with inclined transverse grooves so as to produce spaced parallel ribs 90. These are complementary to a segment of a screw thread to be produced, but are of a length less than the circumference of that thread. The ribs 90 are extended upwardly beyond the arcuate portions of the ridges 88 and 89 along the flat parallel sidewalls 91 and 92 of the punch, which connect to the outer portions of the ridges.

When the workpiece is fed to the punch 81 and die 82, it is flat and rectangular, but previously provided with a generally rectangular central cutout 94 in a conventional manner. The press then is closed and the workpiece is given the configuration shown in FIG. 18. Thus, the central part 95 on either side of the cutout 94 is deflected by the punch downwardly into the cavity 84 in the die 82, and the ridges 88 and 89 produce opposite arcuate corner sections 96 and 97. In the latter areas, the ribs 90 of the ridges form grooves 98 which are the equivalent of screw thread sections which will become portions of the thread of the barrels 12 and 13 when the part is completed. The grooves 98 at the curved parts 96 and 97 may be formed to the full depth of the thread to be produced. However, inasmuch as the ridges 88 and 89 are spaced apart and are cylindrical segments, the thread grooves 98 taper in depth at their adjacent inner ends where they meet the flat part 99 of the workpiece intermediate the grooves (see FIG. 21). Each thread groove 98 extends for only a few degrees, being considerably shorter than the circumference of the completed barrels 12 and 13.

The die 101 in the next forming stage, shown in FIG. 19, has flat upper surface 102 and a central cavity 103 that is similar to, but deeper and narrower than, the cavity 84 in the die 82. The bottom wall 104 of the cavity 103 is flat and its side edges 105 and 106 are curved as cylindrical segments.

The punch 107 in FIG. 19 has parallel ridges 108 and 109 on its lower edge which are opposite from the die edges 105 and 106, and define circular segments in end elevation. The radius for the ridges 108 and 109 is the same as for the ridges 88 and 89 of the punch 81, but the ridges 108 and 109 are closer together than the ridges 88 and 89 of the punch 81. Ribs 110 on the ridges 108 and 109 extend upwardly along the parallel sidewalls 111 and 112 that connect to the outer parts of the curved ridges 108 and 109. The ribs 110 are complementary to a segment of a thread to be produced.

When the workpiece 80 is struck by the punch 107, an additional increment of the screw thread is formed, extending the thread grooves 98 inwardly toward each other. The portion of the workpiece hit by the punch 107 overlaps that hit by the punch 81 so that the previously tapered ends of the grooves 98 are made to the full thread depth and become part of the groove extensions (FIG. 22). There is, however, a narrower flat portion 99 remaining intermediate the grooved portions where the workpiece has not been formed by the punch 107 and has no grooves in it. The thread grooves 98, therefore, taper in depth at their adjacent ends although otherwise they are of full thread depth. In the punch and die 107 and 101, a greater curvature is imparted to the side grooved portions 96 and 97 at the curved parts 105 and 106 of the die, which causes the side sections 114 and 115 of the workpiece, beyond the center section 95, to lift upwardly and rotate toward each other, as illustrated in FIG. 19.

The die 117 of FIG. 20 has a cavity 118 which has an arcuate bottom 119 and parallel sidewalls 120 and 121 that are flat.

The punch 122 has a single ridge 123 with an arcuate bottom surface and ribs 124 complementary to portions of the thread. The opposite sidewalls 125 and 126 of the punch are flat and parallel, and a little closer together than the internal diameter of the threaded barrels 12 and 13. When the workpiece is introduced into the punch and die 122 and 117, the punch ridge 123 strikes the central portion 99 of the workpiece, driving it into the arcuate bottom part 119 of the cavity 118 and completing the formation of the thread grooves. The area of the workpiece engaged by the punch 122 is wider than the ungrooved portion 99 of the workpiece so that the ribs 124 overlap into portions previously engaged by the ribs 110. In this way, all of the grooved portion of the workpiece is formed to a depth corresponding to the full depth of the desired screw thread. The workpiece receives additional curvature at the punch 122 and die 117, which causes the side sections 114 and 115 to rotate further toward each other.

Figure 8:
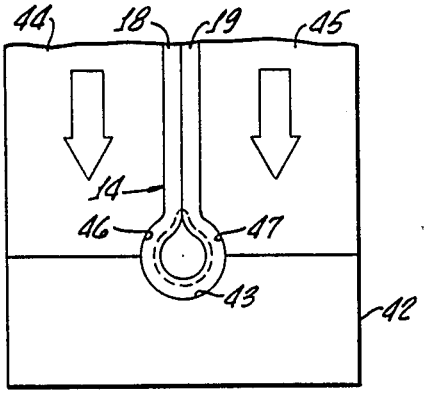
FIG. 8 is an end elevational view of the die stage as the part is completed.

With the thread grooves being completed, the barrels 12 and 13 then are shaped as shown in FIGS. 7 and 8 to complete the part 10.

Figure 23:
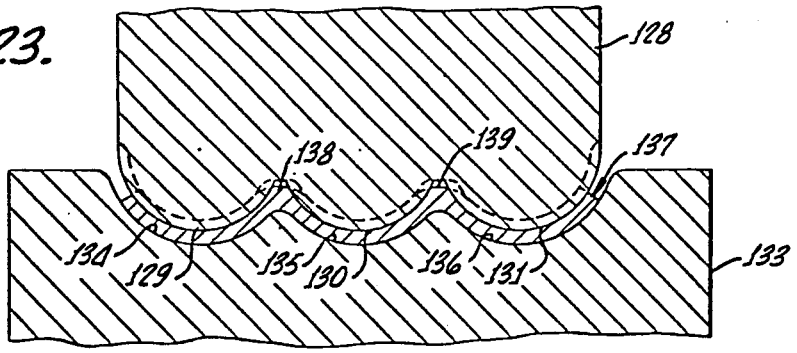
FIG. 23 is an end elevational view showing the formation of a different part at its first die stage.
Figure 24:
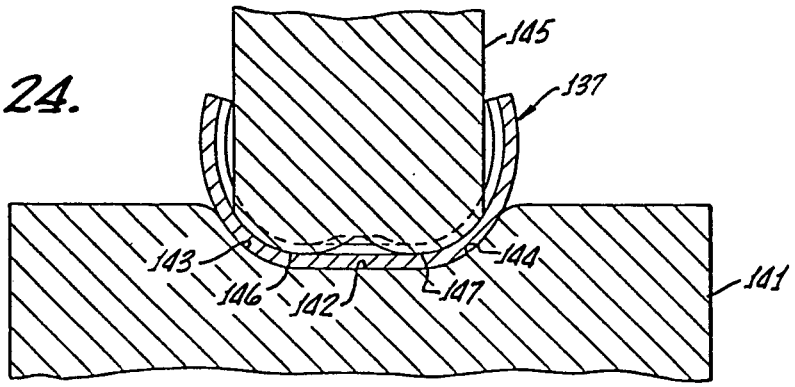
FIG. 24 is an end elevational view of the second die stage.

FIGS. 23 and 24 illustrate a modified way of forming a cylindrical barrel, again using arcuate ridges which engage portions of the workpiece during formation of the thread grooves. The punch 128 of FIG. 23 has three parallel ridges 129, 130 and 131 on its lower surface, each defining a segment of a circle in end elevation, and having ribs for producing thread grooves. These ridges are positioned one next to the other, such that extensions of their surfaces would be tangent.

The cavity of the die 133 has three sections 134, 135 and 136 which are cylindrical segments of a slightly larger radius located immediately below the ridges 129, 130 and 131. The sheet metal workpiece 137 is flat when positioned between the punch 128 and die 133, and then given the undulant contour illustrated when the punch is advanced on the downward stroke of the press. The result is the production of full depth thread grooves in portions of the workpiece immediately below the ridges 129, 130 and 131. However, at the peaks 138 and 139 of the workpiece between adjacent ridges of the punch, no thread forming takes place and the depths of the grooves become progressively more shallow as the arcuate sections of the workpiece approach these peaks.

In the next step, shown in FIG. 24, the die 141 has a cavity 142 with a flat bottom wall and curved side sections 143 and 144. The punch 145 has shallow convex ridges 146 and 147 with ribs for forming thread grooves. When the workpiece is struck by the punch 145 and driven into the cavity 142 in the die 141, the ridges 146 and 147 engage and flatten the peaked portions 138 and 139 of the workpiece and form thread grooves at those locations The engagement by the punch 145 overlaps the areas hit by the punch 128 so that the grooves are given a full and uniform depth throughout their lengths. As the workpiece 137 is formed by the punch 145 and die 141, the side parts of the workpiece bend upwardly around the sides of the punch, as illustrated.

In the next steps, similar to those of FIGS. 12 and 13, the threaded barrel is completed. The result is a complete stamped, threaded barrel with accurately formed threads.

Special problems arise when the workpiece is of a very hard material, such as 316 stainless steel. This material is strong and corrosion-resistant, but it work-hardens quite rapidly so that the thread forming technique of FIGS. 25 through 30 is preferred. Otherwise, either the thread grooves cannot be formed to the proper dimension and definition or die breakage will occur after the production of a relatively few parts.

The part illustrated as being formed in FIGS. 25 through 30 is a threaded sleeve, such as the threaded sleeve 50 of FIG. 9, although, of course, the arrangement illustrated in these figures is applicable to various kinds of internally-threaded parts. Initially, the workpiece 53, in this instance comprising 316 stainless steel, is given a curvature, as indicated in FIG. 14. Thus, the workpiece is forced by the curved lower end 68 of a punch 67 into the die cavity 66, giving the workpiece 53 the contour of a segment of a cylinder. No thread grooves are formed during this procedure. As before, the workpiece has a radius of curvature considerably greater than that of the completed part, preferably having an angular extent of around 120°.

Figure 25:
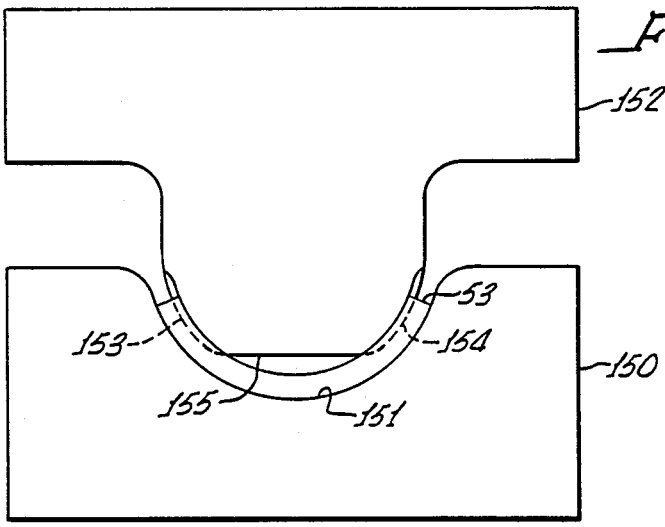
FIG. 25 is an end elevational view of a punch and die used in the formation of thread grooves in hard materials.

Next, the workpiece is advanced to a die 150, shown in FIG. 25, having a cavity 151 which is identical to the cavity 66 of the die 65. There, the workpiece is struck by a punch 152 which forms the two outer end segments of the thread grooves, leaving the central portion of the workpiece 53 ungrooved. About one-half of the workpiece 53 longitudinally of the thread grooves, that is to say, about a distance equal to one-half of the circumference of the completed part, is given groove by the punch 152.

Figure 28:
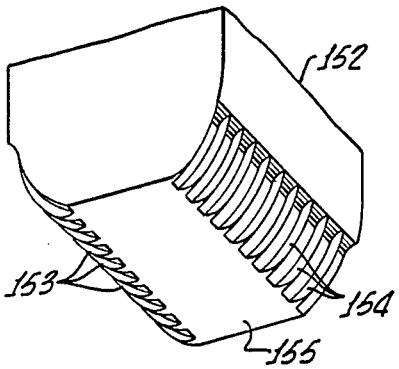
FIG. 28 is a fragmentary perspective view of the punch of FIG. 25.

As seen in FIGS. 25 and 28, the punch 152 has spaced side portions that are curved and provided with parallel sets of ribs 153 and 154. In between the sets of ribs 153 and 154, the punch surface 155 is recessed so that it will clear the workpiece 53 when the punch strikes the workpiece. The ribs 153 and 154 at their crests, in end elevation, are circular, having the radius of curvature of the cavity 151, less the thickness of the part at the root of the thread that is to be produced. The spacing between adjacent ribs 153 and between adjacent ribs 154 is the same as the pitch of the thread of the finished part. Ribs 153 and 154 are at an angle relative to the axis of the curved part of the punch to enable a helical thread to be produced, and individual ribs 153 are aligned with ribs 154. The inner ends of the ribs 153 and 154 taper in dimension as they approach the intermediate surface 155.

Figure 29:
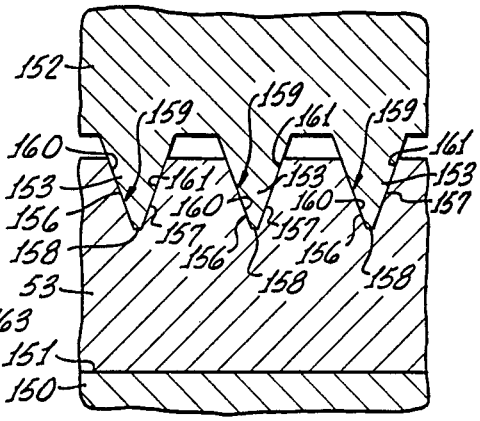
FIG. 29 is an enlarged fragmentary sectional view, taken along line 29—29 of FIG. 26.

The ribs 153 and 154, which are identical in cross section, are narrower than are the groove of the thread of the completed part. These ribs, as shown in FIG. 29 for the ribs 153, have opposed flat flanks 156 and 157 with an included angle of 40° between them. The flanks 156 and 157 converge at a relatively sharp peak 158, although the latter may be flattened or rounded to some degree.

When the punch 152 strikes the workpiece 53, the grooves 159 formed in the workpiece by the ribs 153 and 154 are complementary to the ribs. Hence, the grooves have an included angle of 40° between their flat flanks 160 and 161. These grooves are generally wedge-shaped in cross section. The depth of the grooves 159 may be that of the groove of the completed threaded part. The spacing between adjacent grooves 159 is that of the pitch of the thread.

The workpiece 53 then enters a die 163 having a cavity 164 curved the same as the cavities 66 and 151. There, the workpiece 53 is struck by a punch 165 provided with ribs 166 which are similar to the ribs 29 of the punch 25 of FIG. 4 and the ribs 57 of the punch 56 of FIG. 11, except that the flanks of the ribs 166 have an included angle of 40°. As a result, the ribs 166 of the punch 165, which have the same cross section as that of the ribs 153 and 154, extend the grooves 159, interconnecting the inner end portions of these grooves previously formed by the ribs 153 and 154. Only the central parts of the ribs 166 do any groove forming, because the outer end segments of the grooves 159 already were formed by the punch 152. Because of this, the outer parts of the ribs 166 can be eliminated.

Figure 27:
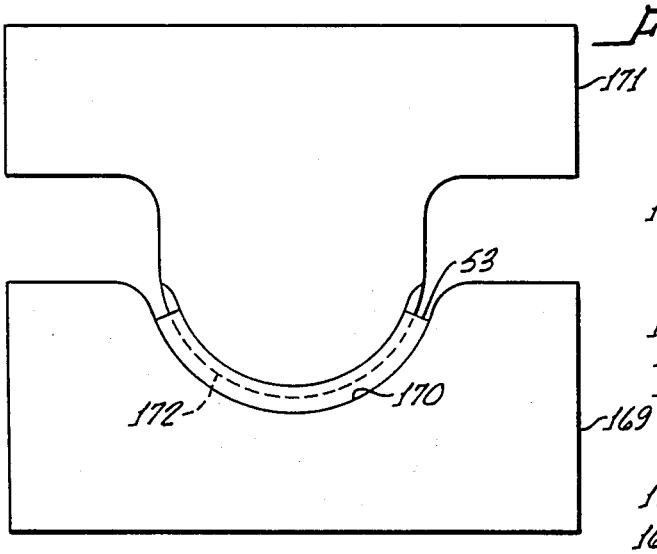
Figure 30:
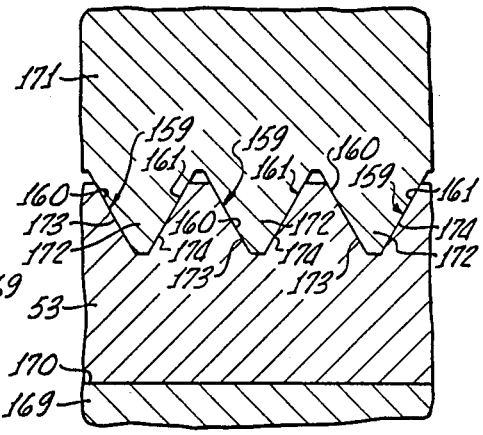
FIG. 30 is an enlarged fragmentary sectional view, taken along line 30—30 of FIG. 27.

The final formation of the thread grooves takes place in a succeeding die stage, shown in FIG. 27, where the die 169 has a cavity 170 curved the same as the die cavities 151 and 164. The punch 171, which strikes the workpiece 53 while in the die 169, is provided with spaced ribs 172 on its curved lower end, which are the same as the ribs 166 of the die 165, except that they are complementary to the thread to be produced. Therefore, the included angle between the flanks 173 and 174 of these ribs, as shown in FIG. 30, is 60° for producing a standard screw thread. Consequently, the grooves 159 of the workpiece 53 are widened and then have a 60° included angle between their flanks 160 and 161.

Figure 31:
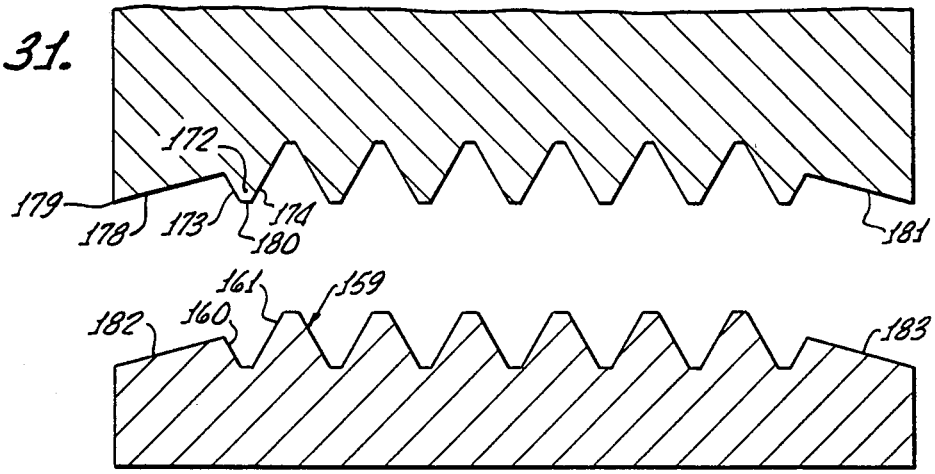
FIG. 31 is an enlarged fragmentary transverse sectional view of the punch of FIG. 27 together with the workpiece as formed by that punch.
Figure 26:
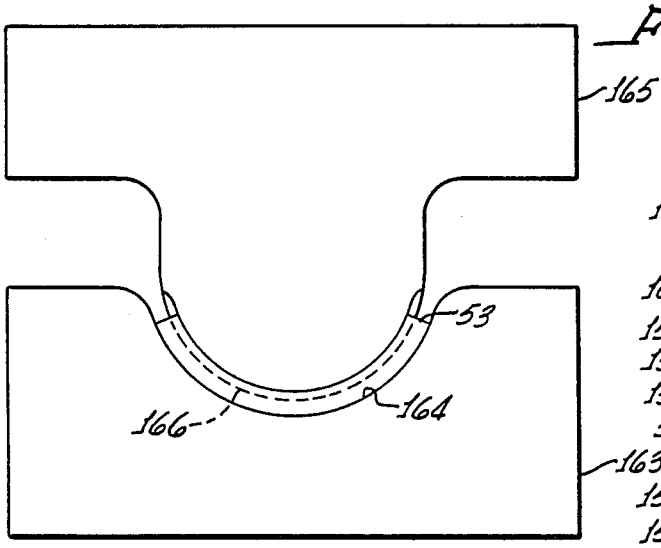
FIGS. 26 and 27 are views similar to FIG. 25, but illustrating succeeding die stages.

The life of the punches of FIGS. 25, 26 and 27 is extended by providing downwardly projecting edge portions beyond the ribs that form the grooves, as seen in FIG. 31. The punch 171 is illustrated in this figure with edge portions 176 and 177 beyond the ribs 172. A flat beveled surface 178 forms the lower periphery of the edge portion 176, extending downwardly from the midportion of the outermost rib flank 173 to an outer corner 179 that is aligned with the crests 180 of the ribs 172. The surface 178 may be at an angle of 15° relative to a horizontal plane. A similar bevel 181 extends from the outermost rib flank 174 on the opposite side of the punch at the edge portion 177. As a result, chamfers 182 and 183 are formed on the workpiece 53 at the side edges of the thread grooves. The edge portions 176 and 177 reinforce the outer ribs 172, strengthening them so that they do not break prematurely. Also, when the part extends beyond the thread grooves so that the thread grooves at one end are not at an edge of the part, the inner edge portion 176 or 177 then creates a resistance when it strikes the workpiece, preventing the punch from sinking too deep into the workpiece.

After the completion of the thread grooves 159, the workpiece 53 is formed to a cylindrical shape in a manner similar t that described above.

The foregoing detailed description is to be clearly understood as given by way of illustration and example only, the spirit and scope of this invention being limited solely by the appended claims.

What is claimed is:

1. The method of producing a threaded element for use in providing a threaded part comprising the steps of providing a first means having at least one portion concavely curved to define a cavity, providing a second means having at least one portion having a convex curvature, forming a plurality of ribs on said portion of said second means such that said ribs in elevation at the crests thereof collectively are complementary to said cavity less a predetermined distance, and relatively moving said first and second means so as to engage a sheet metal workpiece and to cause said portion of said second means to force at least a portion of said workpiece against the wall of said cavity so that said ribs provide grooves in said workpiece and ridges intermediate said grooves, said workpiece being dimensioned so that circumferentially of said cavity when said portion of said workpiece is so forced against the wall of said cavity it extends through an arc of no more than around 120°.

2. The method as recited in claim 1 in which said workpiece is substantially flat prior to when said first and second means are so relatively moved, and said first and second means impart the curvature of said cavity to said workpiece upon so being relatively moved.

3. The method as recited in claim 1 in which prior to so moving said first and second means said workpiece is given a curvature corresponding to that of said cavity, and then is positioned within said cavity.

4. The method as recited in claim 1 in which said second means is provided with at least two portions of a convex curvature having ribs formed thereon, one of said portions first engaging one segment of said workpiece and producing said grooves and ridges of a first length, another of said portions thereafter engaging another segment of said workpiece and extending said grooves and ridges to a second length.

5. The method as recited in claim 1 in which second means is provided with at least two portions of a convex curvature having ribs thereon, the ribs on the first of said portions providing said grooves with a first cross-sectional dimension less than the cross-sectional dimension of the grooves of the thread of said internally threaded part, the ribs on the second of said portions increasing the cross-sectional dimension of said grooves in said workpiece.

6. The method as recited in claim 5 in which said ribs on the second of said portions increases the widths of said grooves in said workpiece.

7. The method of producing a threaded element for use in provided a threaded part comprising the steps of providing a die having a curved cavity, providing a punch having a plurality of parallel ribs which are complementary in cross section to the thread of said threaded part, said ribs being curved such that said ribs at the crests thereof are complementary to said cavity less the thickness of said part between the root of said thread and the exterior surface thereof, said ribs being inclined relative to the axis of curvature thereof, and striking a sheet metal workpiece with said punch so as to force at least a portion of said workpiece on one side thereof against the wall of said cavity and to cause said ribs on said punch to form complementary grooves of uniform depth in the other side of said workpiece, said workpiece being dimensioned so that circumferentially of said cavity when said portion of said workpiece is so forced against the wall of said cavity it extends substantially through an arc of no more than around 120°.

8. The method as recited in claim 7 in which said sheet metal workpiece initially is substantially flat and is given a curvature by said punch and said die cavity.

9. The method as recited in claim 7 in which said sheet metal workpiece initially is substantially flat, then is given a curvature, and then is introduced into said cavity to be so struck by said punch.

10. The method as recited in claim 7 in which said workpiece is so struck by said punch only a single time to form said grooves in said workpiece.

11. The method as recited in claim 7 in which after being so struck by said punch said workpiece is given a greater curvature so as to bring opposite edges thereof into adjacency and define a generally cylindrical shape to produce said threaded part.

12. The method as recited in claim 11 in which said punch is formed so that the crests of said ribs fall along an imaginary cylindrical segment having a radius of curvature equal to approximately three times the radius of curvature of said threaded part at the root of the thread thereof.

13. The method as recited in claim 7 in which more than one of said workpieces are formed, and said workpieces are assembled to define a generally cylindrical shape to produce said threaded part.

14. The method a recited in claim 13 including the step of fitting an annular member around said workpieces so assembled for holding said workpieces so assembled.

15. The method as recited in claim 7 in which two of said workpieces are so produced, and in which after being so struck by said punch the curvature of each of said workpieces is increased to become generally semi-cylindrical, and said workpieces are assembled with their edges in adjacency to define a generally cylindrical shape and provide said threaded part.

16. The method as recited in claim 15 in which said punch is formed so that the crests of said ribs fall along an imaginary cylindrical segment having a radius of curvature equal to approximately one and one-half times the radius of curvature of said threaded part at the root of the thread thereof.

17. The method of producing an arcuate element having a partial thread in one surface thereof which partial thread is of a predetermined depth and configuration such that said element can be given an increased curvature to provide an internally threaded part, or can be combined with other similar elements to provide an internally threaded part, or can be both given an increased curvature and combined with other similar elements to provide an internally threaded part, comprising the steps of providing a die having a cavity defined by a cylindrical segment, providing a punch having a convex curvature and having a plurality of ribs thereon collectively complementary in cross section to said partial thread with the crests of said ribs falling along an imaginary cylindrical segment the radius of curvature of which is less than the radius of curvature of said cavity by approximately the thickness of said threade element at the root of said partial thread therein, with said ribs being inclined relative to the axis of curvature of said imaginary cylindrical segment, and then engaging one side of a sheet metal workpiece by said punch and forcing at least a portion of said workpiece into said cavity to assume the contour thereof and to provide grooves in said workpiece and ridges intermediate said groove having the full cross-sectional configuration of said partial thread, with said workpiece being given a dimension such that when said workpiece so assumes the contour of said cavity said workpiece at said grooves and ridges thereof extends substantially through an arc of no more than around 120°.

18. The method of providing an internally threaded part comprising the steps of providing a die having a curved cavity having a curvature substantially less than the curvature of said threaded part, providing a punch having a plurality of ribs thereon collectively complementary in cross section to the thread of said threaded part and having an end elevational contour at the crests of said ribs complementary to said cavity less a distance approximately equal to the thickness of said threaded part from the root of the thread thereof to the outer surface thereof, providing a sheet metal workpiece, striking said workpiece by said punch so as to force said workpiece against the wall of said cavity while said ribs form grooves in said workpiece having substantially the full contour of said thread, and then imparting a cylindrical shape to said workpiece so as to bring the ends of said grooves into registry and thereby produce an internally threaded part.

19. The method as recited in claim 18 in which said workpiece is a substantially flat member having a lateral dimension substantially equal to the circumference of said threaded part at the root of the thread therein.

20. The method as recited in claim 18 in which said punch in end elevation is made to contour having the shape of a segment of a cylinder which has a radius of curvature equal to approximately three times to $\pi$ times the radius of curvature of said threaded part at the root of said thread.

21. The method as recited in claim 20 in which said workpiece is a substantially flat sheet metal member which is positioned over said cavity before being so struck by said punch, said workpiece being forced into said cavity by said punch and caused to assume the contour of said cavity when said workpiece is so struck by said punch.

22. The method as recited in claim 20 in which said workpiece is so struck by said punch only a single time in so forming said grooves therein.

23. The method as recited in claim 18 in which in so imparting a cylindrical shape to said workpiece said workpiece is engaged with at least one additional punch and at least one additional die, said additional die having a cavity having a greater curvature than that of said first mentioned cavity, said additional punch having ribs thereon complementary to said grooves, said ribs of said additional punch extending into said grooves for preserving the contour thereof.

24. The method as recited in claim 18 in which said die is provided with a generally flat upper surface, and said workpiece is a flat member and is positioned on said upper surface prior to being so struck by said punch.

25. The method as recited in claim 24 in which said die is provided with convexly rounded edges interconnecting said cavity and said upper surface.

26. The method of providing an internally threaded part with a helical thread therein comprising the steps of providing a first means having a cavity defined by a cylindrical segment the radius of curvature of which is substantially greater than the radius of curvature of said threaded part, providing a second means having a convex curvature and having a plurality of ribs thereon collectively complementary in cross section to said thread with the crests of said ribs falling along an imaginary cylindrical segment the radius of curvature of which is less than the radius of curvature of said cavity by approximately the thickness of said part at the root of said thread, with said ribs being inclined relative to the axis of curvature of said imaginary cylindrical segment, engaging a sheet metal workpiece by said second means and forcing at least a portion of said workpiece into said cavity so as to impart the curvature of said cavity to said workpiece and provide grooves in said workpiece and ridges intermediate said grooves by said ribs of said second means, which grooves and ridges of said workpiece are of the full cross-sectional configuration of said thread, and then bending said workpiece to a cylindrical shape with the ends of said ridges of said workpiece in registry so as to provide an internally threaded part.

27. The method as recited in claim 26 in which said workpiece is so engaged by said second means by striking said workpiece only a single time with said second means in so forcing said workpiece into said cavity and producing said grooves in said workpiece and said ridges intermediate said grooves.

28. The method as recited in claim 26 in which said radius of curvature of said imaginary cylindrical segment is approximately within the range of three times to $\pi$ times the radius of curvature of said threaded part at the root of the thread thereof.

29. The method of producing an internally threaded part having a known radius of curvature comprising the steps of providing a die having a cavity having a predetermined radius of curvature, positioning a sheet metal workpiece so that one side thereof is adjacent said cavity, striking the opposite side of said workpiece at least once and with a punch having parallel ribs thereon having a radius of curvature comparable to said radius of curvature of said cavity less an allowance for the thickness of said workpiece, the radius of curvature of said punch at the crests of the ribs thereof being made to be no less than approximately three times the radius of curvature of said internally threaded part at the root of the thread thereof, such that grooves substantially complementary to said ribs are formed in said opposite side of said workpiece and said one side of said workpiece is forced against the surface of said cavity, and then increasing the curvature of said workpiece to said known radius of curvature of said internally threaded part and bringing the ends of said grooves into registry so as to result in said internally threaded part.

30. The method of producing a part having a screw thread of predetermined depth and circumferential dimension comprising the steps of engaging a sheet metal workpiece with a first two means, one of which is provided with a plurality of substantially parallel ridges thereon so as to cause said ridges to produce grooves in said workpiece of a depth substantially equal to said predetermined depth of said screw thread and a length less than said circumferential dimension of said screw thread, while leaving remaining portions of said workpiece without any grooves, engaging said remaining portions of said workpiece with at least two additional means, one of which is provided with a plurality of parallel ridges thereon to extend said grooves substantially at said predetermined depth of said screw thread to a length equal to said circumferential dimension of said screw thread, and bending said workpiece to a cylindrical shape with the ends of said groove in alignment so that said grooves produce a screw thread.

31. The method as recited in claim 30 in which said grooves are formed in spaced segments and then so extended from said segments toward each other.

32. The method as recited in claim 31 in which the adjacent ends of said grooves so formed in said spaced segments taper to a depth less than said depth of said screw thread, and when said spaced segments are so extended toward each other said ridges of said additional means engage said workpiece at said ends of said segments of said grooves so as to increase the depth thereof to that of said screw thread as said grooves are so extended.

33. The method of producing a part having a screw thread of predetermined depth and circumferential dimension comprising the steps of providing a means having a plurality of ribs thereon of a depth corresponding to said predetermined depth of said screw thread, said ribs being made shorter than said circumferential dimension of said screw thread, striking a sheet metal workpiece with said means so that said ribs produce grooves therein which are of a depth corresponding to said predetermined depth and a length less than said circumferential dimension of said screw thread, again striking said workpiece with said means so as to extend said grooves at said predetermined depth to a length substantially equal to said circumferential dimension of said screw thread, and bending said workpiece to a cylindrical shape so that the ends of said grooves are in alignment and said grooves define a screw thread.

34. The method as recited in claim 33 in which a curvature is imparted said workpiece when said workpiece is so struck by said means.

35. The method as recited in claim 34 in which the portion of said workpiece so again struck by said means overlaps the portion of said workpiece previously struck by said means.

36. The method a recited in claim 35 in which said means is provided with ridges formed so as to be segments of a circle as said ridges are viewed in end elevation, said ribs being formed on said ridges, and in which said means includes a die having a cavity having at least one arcuate surface which is a segment of a circle in end elevation, said workpiece being forced into said cavity against said arcuate surface thereof when so struck by said means.

37. The method of producing a threaded part comprising the steps of providing a punch means having a plurality of curved protrusions, each of said protrusions being contoured to define a plurality of parallel ribs thereon of a depth equal to that of a screw thread to be produced, but of a length less than the circumference of said thread, providing a die means having cavity means with a plurality of curved surfaces, the circumferential dimensions of which are less than the circumference of said screw thread, engaging a sheet metal workpiece with said punch means and die means so that selected ones of said protrusions force said workpiece into said cavity means and against selected ones of said curved surfaces thereof, and said ribs of said selected protrusions form grooves in said workpiece of a depth equal to that of said screw thread and of a length less than said circumference of said screw thread, again engaging said workpiece with said punch means and die means so that additional ones of said protrusions force said workpiece into said cavity means and against additional ones of said curved surfaces of said die means, and said ribs of said additional protrusions extend said grooves in said workpiece at a depth equal to that of said screw thread to a length equal to said circumference of said screw thread, and then bending said workpiece to form a substantially cylindrical shape with the ends of said grooves in alignment so as to define said screw thread.

38. The method as recited in claim 37 in which when so engaging said sheet metal workpiece thread said protrusions so force said workpiece against three of said curved surfaces of said cavity means, and when so again engaging said workpiece two of said protrusions force said workpiece against two of said curved surfaces of said cavity means.

39. The method as recited in claim 37 in which when so engaging said sheet metal workpiece two of said protrusions so force said workpiece against two of said curved surfaces of said cavity means, and when so again engaging said workpiece two of said protrusions first so force said workpiece against two of said curved surfaces of said cavity means, after which one of said protrusions so forces said workpiece against one of said surfaces of said cavity means.

40. The method of producing a part having a threaded barrel comprising the steps of providing a punch with spaced parallel protrusions defining cylindrical segments with a plurality of parallel ribs on each of said protrusions complementary to a portion of a screw thread to be produced, but of a length less than the circumference of said screw thread, providing a first die with a cavity having spaced arcuate portions defining cylindrical segments, engaging said workpiece with said first punch and said first die so that said workpiece is forced into said cavity, and said protrusions of said punch and said arcuate portions of said die cooperate to impart a curvature to said workpiece, and said ribs produce grooves in said workpiece of a length less than said circumference of said screw thread while a portion of said workpiece intermediate said protrusions of said first punch do not receive such grooves, providing a second punch with spaced parallel protrusions defining cylindrical segments which are closer together than said protrusions of said first punch, each of said protrusions of said second punch being formed to have a plurality of parallel ribs thereon complementary to a portion of a screw thread to be produced, but of a length less than said circumference of said screw thread, providing a second die with a cavity having spaced arcuate portions defining cylindrical segments which are closer together than said arcuate portions of said first die, then engaging said workpiece with said second punch and second die so that said protrusions of said second punch and said arcuate portions of said second die impart a curvature to said workpiece and said spaced ribs of said second punch extend said grooves in said workpiece, and then forming said workpiece to a cylindrical shape so that said grooves define said screw thread.

41. The method as recited in claim 40 including the steps of providing a third punch with a single protrusion defining a cylindrical segment formed to have a plurality of parallel ribs thereon complementary to a portion of a thread to be produced, but of a length less than said circumference of said thread, providing a third die with a cavity having an arcuate bottom surface, and, before said forming said workpiece to a cylindrical shape, engaging said workpiece with said third punch and third die so that said protrusion and said arcuate bottom surface impart curvature to said workpiece and said spaced ribs of said third punch extend said grooves in said workpiece.

42. The method of producing a threaded part comprising the steps of providing a first punch and first die means, said first punch having a plurality of curved convex protrusions, each of said protrusions being contoured to define a plurality of parallel ribs thereon of a depth equal to that of a screw thread to be produced but of length less than the circumference of said thread, said first die means being provided with a cavity having a curved concave surface opposite each of said protrusions, each of said curved concave surfaces being given a circumferential dimension less than said circumference of said thread, providing at least one additional punch and die means, said additional punch including at least one curved convex protrusion contoured to define a plurality of parallel ribs thereon of a depth equal to that of said thread to be produced but of a length less than the circumference of said thread, said additional die means being provided with a cavity having a curved concave surface opposite said protrusions of said additional punch, each of said curved concave surfaces of said additional die means being given a circumferential dimension less than said circumference of said thread, engaging a sheet metal workpiece at a first location by said protrusions of said first punch and forcing said workpiece into said cavity of said first die means and against said curved concave surfaces of said first die means to as to impart a curvature to said workpiece and so that said ribs of said protrusions of said first punch form grooves in said workpiece of a depth equal to said depth of said screw thread and of a length less than said circumference of said screw thread, engaging said workpiece at a second location by said protrusion of said second punch and forcing said workpiece into said cavity of said additional die means and against said curved concave surface of said additional die means so as to impart curvature to said workpiece and so that said ribs of said protrusions of said additional punch form grooves in said workpiece of a depth equal to said depth of said screw thread which are extensions of said grooves formed by said ribs of said protrusions of said first punch, and so that said grooves as so extended are equal in length to said circumference of said screw thread, and then forming said workpiece to a cylindrical shape with the ends of said grooves in alignment so as to produce a screw thread.

43. The method as recited in claim 42 in which said second location overlaps said first location.

44. The method as recited in claim 43 in which there are provided two of said additional punch and die means, one of which includes a punch having two of said protrusions and a die means having a curved convex surface opposite each of said two protrusions, and the other of which includes a punch having one of said protrusions and a die means having one curved concave surface opposite said one protrusion, said grooves being extended first by said protrusions of said one additional punch and then extended to the length of said circumference by said protrusion of said other additional punch.

45. The method of producing part having a screw thread of predetermined configuration and circumferential dimension comprising the steps of engaging a sheet metal workpiece with a first two means, one of which is provided with a plurality of substantially parallel ribs thereon so as to cause said ribs to produce grooves in said workpiece of a length less than said circumferential dimension of said screw thread, while leaving remaining portions of said workpiece without any such grooves, engaging said remaining portions of said workpiece with at least two additional means, one of which is provided with a plurality of parallel ribs thereon to extend said grooves to a length equal to said circumferential dimension of said screw thread, and bending said workpiece to a cylindrical shape with the ends of said grooves in alignment so that said grooves produce a screw thread.

46. The method as recited in claim 45 in which a curvature is imparted to said workpiece when said workpiece is so struck by said first two means.

47. The method as recited in claim 45 in which a curvature is imparted to said workpiece prior to being so struck by said first two means.

48. The method as recited in either of claims 46 or 47 in which the curvature so imparted to said workpiece is substantially less than the curvature of said workpiece when so bent to a cylindrical shape.

49. The method as recited in claim 48 in which, when said curvature is so imparted to said workpiece, said workpiece extends through an arc of no more than around 120°.

50. The method as recited in claim 45 in which said ribs of said first and of said additional means are shaped so that said grooves as so formed and so extended are narrower than the grooves of said screw thread of said part, and including the additional step of engaging said workpiece with a further means so as to widen said grooves to the width of the grooves of said screw thread of said part.

51. The method as recited in claim 50 in which said grooves when so struck by said first means and so struck by said additional means are provided with flanks having an included angle of around 40° therebetween, and when so struck by said additional means are provided with flanks having an included angle of around 60° therebetween.

52. The method as recited in claim 45 including the step, prior to so engaging said workpiece with said first two means, of bending said workpiece to the shape of a cylindrical segment which has a radius of curvature substantially greater than the radius of curvature of the thread of said part.

53. The method as recited in claim 52 in which said radius of curvature of said cylindrical segment is approximately three times the radius of curvature of the thread of said part.

54. The method as recited in claim 45 in which said workpiece is so engaged by said first two means so as to initially form spaced end portions of said grooves, and said workpiece is so engaged by said additional means so as to form the intermediate portions of said grooves.

55. The method as recited in claim 45 in which said workpiece is of a work hardenable material.

56. The method as recited in claim 45 in which said workpiece is of stainless steel material.

57. The method as recited in claim 45 in which said workpiece is of 316 stainless steel material.

* * * * *